US005676535A

United States Patent [19]

Bushnell

[11] Patent Number: 5,676,535

[45] Date of Patent: Oct. 14, 1997

[54] ENHANCED ROTARY COMPRESSOR VALVE PORT ENTRANCE

[75] Inventor: Paul J. Bushnell, Syracuse, N.Y.

[73] Assignee: Carrier Corporation, Syracuse, N.Y.

[21] Appl. No.: 782,280

[22] Filed: Jan. 9, 1997

Related U.S. Application Data

[63] Continuation of Ser. No. 558,992, Nov. 16, 1995, abandoned.

[51] Int. Cl.[6] ..... F04C 18/356; F04C 29/00

[52] U.S. Cl. ..... 418/63; 418/243

[58] Field of Search ..... 418/63–67, 243–249

[56] References Cited

U.S. PATENT DOCUMENTS

| | | | |
|---|---|---|---|
| 2,243,465 | 5/1941 | Kucher | 418/63 |
| 4,605,362 | 8/1986 | Sturgeon et al. | 418/63 |

FOREIGN PATENT DOCUMENTS

| | | | |
|---|---|---|---|
| 61-182485 | 8/1986 | Japan | 418/63 |
| 62-199988 | 9/1987 | Japan | 418/63 |
| 1193095 | 8/1989 | Japan | 418/63 |
| 2267380 | 11/1990 | Japan | 418/63 |

*Primary Examiner*—John J. Vrablik

[57] ABSTRACT

A relieved portion is provided in the motor end bearing of a rotary compressor in the region of the discharge port. The relief is in the nature of a chamfer or the like and enhances the flow by smoothing the flow path. The relief is limited to the portion of the motor end bearing overlying the cylinder bore so as to limit its contribution to the clearance volume.

7 Claims, 4 Drawing Sheets

ENHANCED ROTARY COMPRESSOR VALVE PORT ENTRANCE

This application is a Continuation of application Ser. No. 08/558,992, filed Nov. 16, 1995, now abandoned.

BACKGROUND OF THE INVENTION

In a fixed vane or rolling piston rotary compressor, the discharge port is in the motor end bearing. The discharge port is located such that about half of it overlies the piston bore and the remainder overlies the cylinder. The portion of the cylinder overlain by the discharge port is recessed to provide a fluid path from the cylinder bore to the discharge port. Accordingly, the discharge port faces the piston bore and recess. To provide a smooth flow path, the entrance to the discharge port is normally chamfered.

The clearance volume is the volume of compressed gas which is not discharged at the end of the compression processes and represents a loss since it was pressurized and not discharged and will expand to form part of the suction volume. In the case of a rolling piston compressor the clearance volume is made up of the volume of the recess in the cylinder and the volume of the discharge port upstream of the discharge valve. A portion of the discharge port volume is made up of the volume of material removed in the forming of the chamfer, a part of which overlies the recessed portion of the cylinder.

SUMMARY OF THE INVENTION

A crescent chamfer is provided in the motor end bearing. The chamfer provides a smooth transition for flow from the compression chamber to the discharge port. Additionally, the chamfer does not extend to the portion of the discharge port overlying the recess in the cylinder thereby avoiding unnecessarily adding to the clearance volume.

It is an object of this invention to reduce the pressure drop across the discharge valve.

It is another object of this invention to minimize the clearance volume.

It is a further object of this invention to provide a smooth transition for the discharge flow. These objects, and others as will become apparent hereinafter, are accomplished by the present invention.

Basically, a crescent shaped chamfer is provided in the portion of the motor end bearing surrounding the discharge port and overlying the piston bore.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
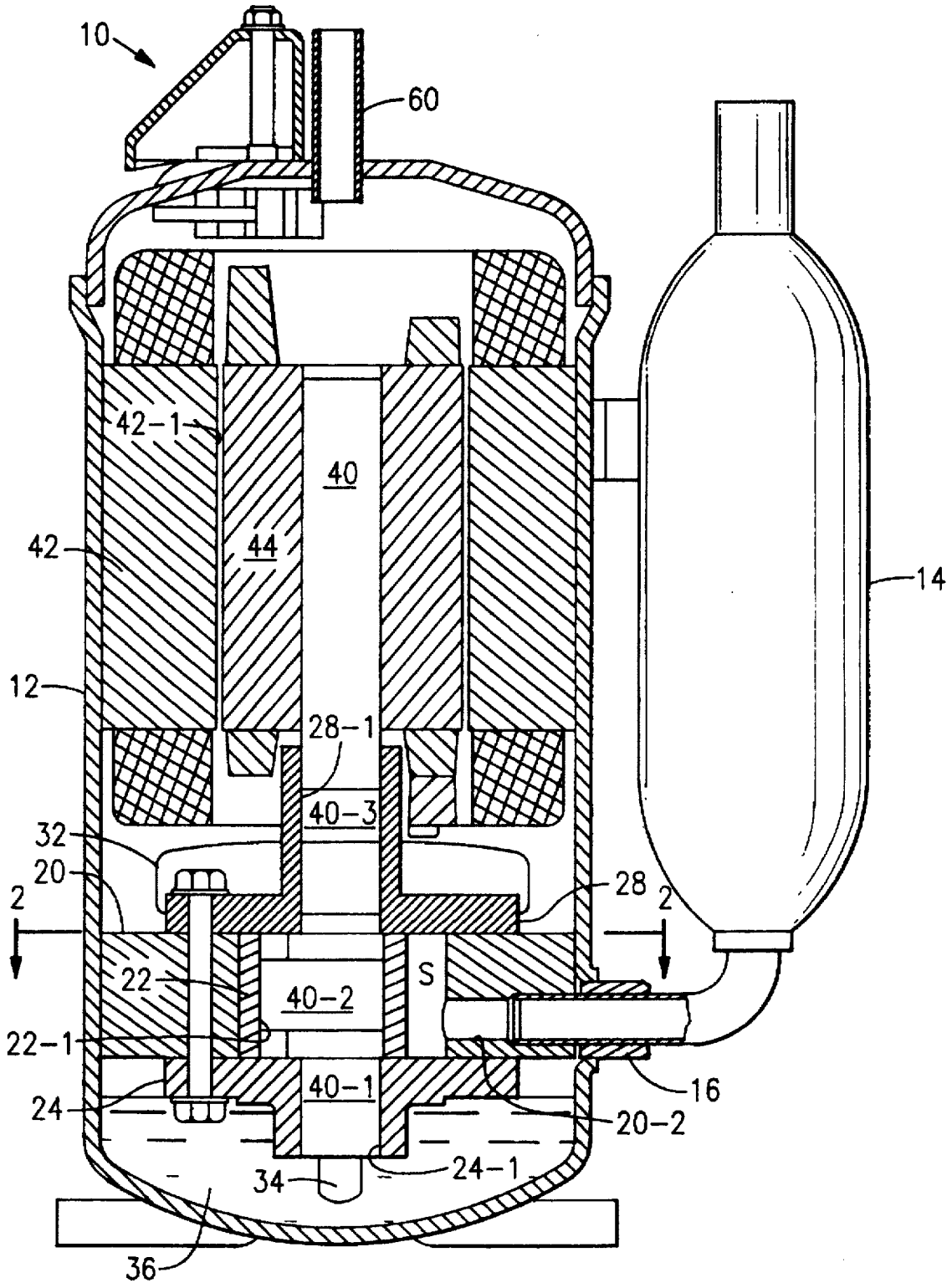
FIG. 1 is a vertical sectional view of a rolling piston compressor taken through the suction structure.
Figure 2:
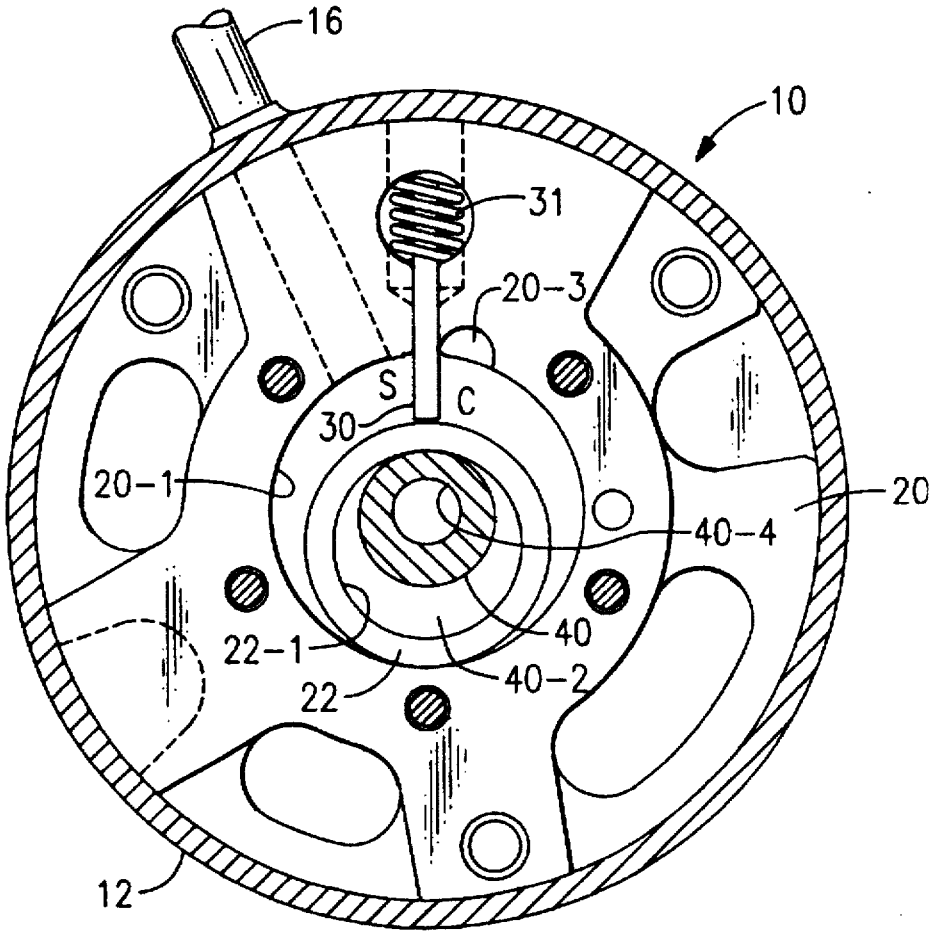
FIG. 2 is a sectional view taken along line 2—2 in FIG. 1.

In FIGS. 1 and 2, the numeral 10 generally designates a vertical, high side rolling piston compressor. The numeral 12 generally designates the shell or casing. Suction tube 16 is sealed to shell 12 and provides fluid communication between suction accumulator 14, which is connected to the evaporator (not illustrated), and suction chamber S. Suction chamber S is defined by bore 20-1 in cylinder 20, piston 22, pump end bearing 24 and motor end bearing 28.

Eccentric shaft 40 includes a portion 40-1 supportingly received in bore 24-1 of pump end bearing 24, eccentric 40-2 which is received in bore 22-1 of piston 22, and portion 40-3 supportingly received in bore 28-1 of motor end bearing 28. Oil pick up tube 34 extends into sump 36 from a bore in portion 40-1. Stator 42 is secured to shell 12 by shrink fit, welding or any other suitable means. Rotor 44 is suitably secured to shaft 40, as by a shrink fit, and is located within bore 42-1 of stator 42 and coacts therewith to define an electric motor. Vane 30 is biased into contact with piston 22 by spring 31.

Figure 3:
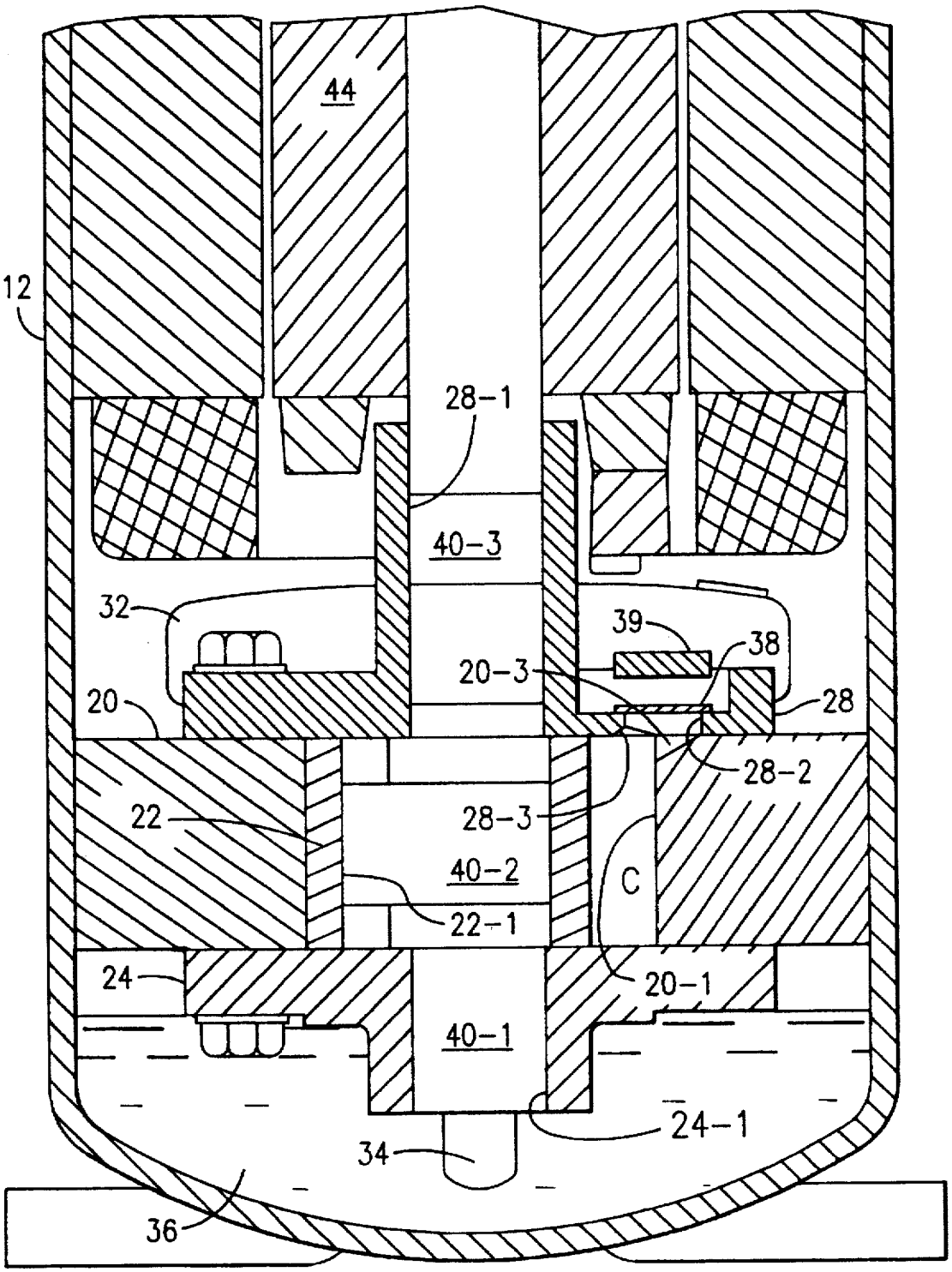
FIG. 3 is a partial vertical sectional view corresponding to that of FIG. 1 but taken through the discharge structure which is the subject matter of this invention.
Figure 4:
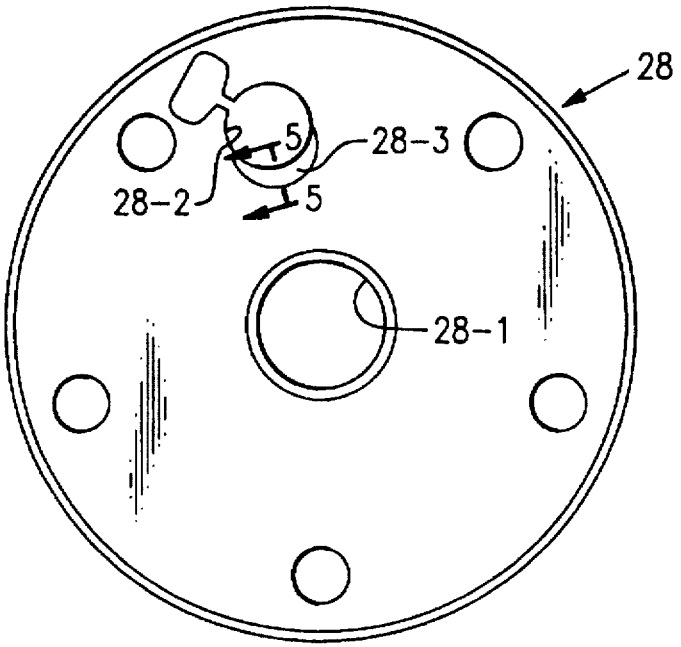
FIG. 4 is a pump end view of the motor bearing.
Figure 5:
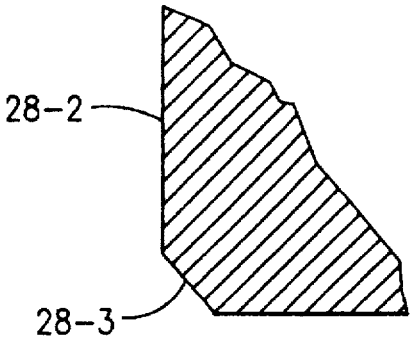
FIG. 5 is a sectional view taken along line 5—5 of FIG. 4.

Referring to FIG. 3, discharge port 28-2 is formed in motor end bearing 28 and partially overlies bore 20-1 and overlies discharge recess 20-3 which is best shown in FIG. 2 and which provides a flow path from compression chamber C to discharge port 28-2. Discharge port 28-2 is serially overlain by discharge valve 38 and spaced valve stop 39, as is conventional. As described so far, compressor 10 is generally conventional. The present invention adds chamfer 28-3 which is best shown in FIGS. 3–5. Chamfer 28-3 is of a crescent shape, nominally 200° in circumferential extent and corresponds to the portion of discharge port 28-2 overlying bore 20-1, or, more specifically, compression chamber C. Except for, possibly, a portion of the tips of the crescent defining the blend from chamfer to no chamfer, the chamfer does not overlie cylinder 20 and thereby add to the clearance volume. Chamfer 28-3 is located, however, where the flow from compression chamber C to discharge port 28-2 would otherwise be over a 90° edge with attendant losses. As best shown in FIG. 5, chamfer 28-3 defines an angle in the 30°–60° range and the dimension of the chamfer would be on the order of 0.5 to 0.8 mm.

In operation, rotor 44 and eccentric shaft 40 rotate as a unit and eccentric 40-2 causes movement of piston 22. Oil from sump 36 is drawn through oil pick up tube 34 into bore 40-4 which acts as a centrifugal pump. The pumping action will be dependent upon the rotational speed of shaft 40. Oil delivered to bore 40-4 is able to flow into a series of radially extending passages, in portion 40-1, eccentric 40-2 and portion 40-3 to lubricate bearing 24, piston 22, and bearing 28, respectively. Piston 22 coacts with vane 30 in a conventional manner such that gas is drawn through suction tube 16 and passageway 20-2 to suction chamber S. The gas in suction chamber S is trapped, compressed and discharged from compression chamber C via a flow path defined by chamfer 28-3 and recess 20-3 into discharge port 28-2. The high pressure gas unseats the valve 38 and passes into the interior of muffler 32. The compressed gas passes through muffler 32 into the interior of shell 12 and passes via the annular gap between rotating rotor 44 and stator 42 and through discharge line 60 to the condenser of a refrigeration circuit (not illustrated).

At the completion of the compression process, piston 22 will be tangent to the bore 20-1, in the region of recess 20-3. The clearance volume will be the volume of recess 20-3, the volume of discharge port 28-2 and the volume of the material removed to form chamfer 28-3. Accordingly, the clearance volume is minimized while providing a smooth flow path due to the reduced extent of chamfer 28-3. However, the portion of the chamfer 28-3 desirable to facilitate flow is maintained.

Figure 6:
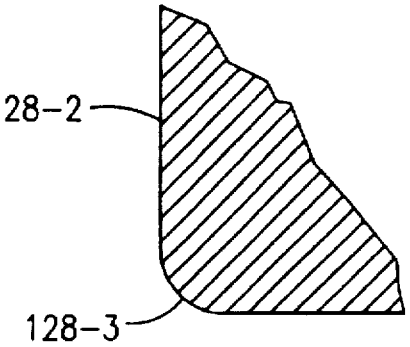
FIG. 6 is a view corresponding to FIG. 5 showing a first modified embodiment.
Figure 7:
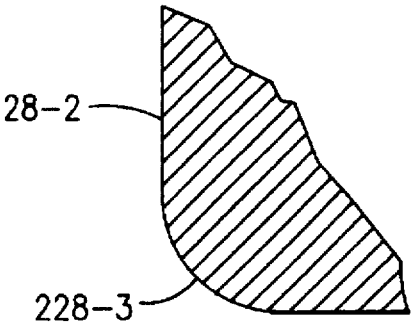
FIG. 7 is a view corresponding to FIG. 5 showing a second modified embodiment.

Rather than being a beveled edge, as in the case of chamfer 28-3, other shapes may be employed. FIG. 6 illustrates the use of circular curve or round 128-3 in place of chamfer 28-3. Similarly, FIG. 7 illustrates the use of elliptical curve 228-3. Round 128-3 and curve 228-3, like chamfer 28-3 would be on the order of 200° in circumferential extent and would have a cord length on the order of 0.5 to 0.8 mm.

Although the present invention has been illustrated and described in terms of a vertical, variable speed compressor, other modifications will occur to those skilled in the art. For example, the invention is applicable to both horizontal and vertical compressors. Similarly the motor may be a variable speed motor. It is therefore intended that the present invention is to be limited only by the scope of the appended claims.

What is claimed is:

1. A high side rotary compressor means comprising:

shell means having a first end and a second end;

cylinder means having a bore containing a pump means including a vane and a piston coacting with said cylinder means to define suction and compression chambers;

said cylinder means being fixedly located in said shell means near said first end;

first bearing means overlying said bore and secured to said cylinder means and extending towards said first end;

second bearing means secured to said cylinder means, overlying said bore and extending towards said second end;

motor means including rotor means and stator means;

said stator means fixedly located in said shell means between said cylinder means and said second end and axially spaced from said cylinder means and said second bearing means;

eccentric shaft means supported by said first and second bearing means and including eccentric means operatively connected to said piston;

said rotor means secured to said shaft means so as to be integral therewith and located within said stator so as to define therewith an annular gap;

suction means for supplying gas to said pump means;

discharge means fluidly connected to said shell means;

a discharge port means located in said second bearing means and having a single relieved portion;

a recess means located in said cylinder means and communicating with said discharge port means;

valve means overlying said discharge port means;

muffler means overlying said valve means;

a discharge flow path extending between said compression chamber and said discharge means and solely including said recess means, said single relieved portion located in said second bearing means and essentially only overlying said bore, said discharge port means, said valve means, said muffler means and the interior of said shell means;

said recess means, said discharge port means and said relieved portion solely constituting a clearance volume; and said recess means and said relieved portion coacting to direct flow into said discharge port means with flow from said discharge port means discharging into said muffler means and thence passing into the interior of said shell means.

2. The compressor means of claim 1 wherein said relieved portion is a chamfer.

3. The compressor means of claim 2 whereto said chamfer is crescent shaped.

4. The compressor means of claim 3 wherein said chamfer is nominally 200° in extent.

5. The compressor means of claim 1 wherein said relieved portion is curved.

6. The compressor means of claim 5 wherein said curved relieved portion is crescent shaped.

7. The compressor means of claim 6 wherein said crescent shaped portion is nominally 200° in extent.

* * * * *